US011626668B2

(12) United States Patent
Li

(10) Patent No.: US 11,626,668 B2
(45) Date of Patent: Apr. 11, 2023

(54) WAVEGUIDE END ARRAY ANTENNA TO REDUCE GRATING LOBES AND CROSS-POLARIZATION

(71) Applicant: Aptiv Technologies Limited, St. Michael (BB)

(72) Inventor: Mingjian Li, Santa Clara, CA (US)

(73) Assignee: Aptiv Technologies Limited, St. Michael (BB)

( * ) Notice: Subject to any disclaimer, the term of this patent is extended or adjusted under 35 U.S.C. 154(b) by 0 days.

(21) Appl. No.: 17/234,369

(22) Filed: Apr. 19, 2021

(65) Prior Publication Data

US 2022/0200160 A1 Jun. 23, 2022

Related U.S. Application Data

(60) Provisional application No. 63/169,104, filed on Mar. 31, 2021, provisional application No. 63/127,842, filed on Dec. 18, 2020.

(51) Int. Cl.
*H01Q 21/00* (2006.01)
*H01Q 13/10* (2006.01)
(Continued)

(52) U.S. Cl.
CPC ..... *H01Q 21/0068* (2013.01); *H01Q 13/10* (2013.01); *H01Q 21/0043* (2013.01);
(Continued)

(58) Field of Classification Search
CPC .. G01S 13/931; H01Q 21/0068; H01Q 13/10; H01Q 21/08; H01Q 1/32; H01Q 1/3233;
(Continued)

(56) References Cited

U.S. PATENT DOCUMENTS 3,462,713 A 8/1969 Knerr
3,579,149 A 5/1971 Ramsey
(Continued)

FOREIGN PATENT DOCUMENTS

CA 2654470 12/2007
CN 1620738 5/2005
(Continued)

OTHER PUBLICATIONS

Makoto Higaki, Jiro Hirokawa, and Makoto Ando, Mechanical Phase Shifting in the Power Divider for Single-Layer Slotted Waveguide Arrays, Feb. 2004, IEICE Trans. Comm., vol. E87-B, No. 2, p. 310-316 (Year: 2004).*
(Continued)

*Primary Examiner* — Ab Salam Alkassim, Jr.
*Assistant Examiner* — Leah Rosenberg
(74) *Attorney, Agent, or Firm* — Sawtooth Patent Group PLLC

(57) ABSTRACT

This document describes techniques, apparatuses, and systems directed to a waveguide end array antenna to reduce grating lobes and cross-polarization. Referred to simply as the waveguide, for short, utilizes a core made of a dielectric material to guide electromagnetic energy from a waveguide input to one or more radiating slots. The dielectric core includes a main channel and one or more forks. Each fork connects the main channel to one or more tine sections, and each tine section is terminated by a closed end and a radiating slot. These radiating slots are separated from each other by a distance to enable at least a portion of the electromagnetic energy to dissipate in phase through the radiating slots. The dielectric core of the waveguide reduces grating lobes and cross-polarization associated with the electromagnetic energy. An automobile can rely on the waveguide to detect objects with increased accuracy.

19 Claims, 6 Drawing Sheets

(51) Int. Cl.
*H01Q 21/08* (2006.01)
*H01Q 1/32* (2006.01)

(52) U.S. Cl.
CPC ..... *H01Q 21/08* (2013.01); *H01Q 1/32* (2013.01); *H01Q 1/3233* (2013.01)

(58) Field of Classification Search
CPC ..... H01Q 21/0037; H01Q 21/0043; H01Q 21/0062; H01Q 21/005; H01Q 21/068
See application file for complete search history.

(56) References Cited

U.S. PATENT DOCUMENTS 4,157,516 A 6/1979 Van De Grijp
4,453,142 A 6/1984 Murphy
4,562,416 A 12/1985 Sedivec
5,982,256 A 11/1999 Uchimura et al.
5,986,527 A 11/1999 Ishikawa et al.
6,489,855 B1 12/2002 Kitamori et al.
6,794,950 B2 9/2004 Du Tolt et al.
6,867,660 B2 3/2005 Kitamori et al.
6,958,662 B1 10/2005 Salmela et al.
7,973,616 B2 7/2011 Shijo et al.
7,994,879 B2 8/2011 Kim et al.
8,013,694 B2 9/2011 Hiramatsu et al.
8,089,327 B2 1/2012 Margomenos et al.
8,159,316 B2 4/2012 Miyazato et al.
8,692,731 B2 4/2014 Lee et al.
9,007,269 B2 4/2015 Lee et al.
9,450,281 B2 9/2016 Kim
9,673,532 B2 6/2017 Cheng et al.
9,935,065 B1 4/2018 Baheti et al.
10,276,944 B1 4/2019 Izadian
10,468,736 B2 11/2019 Mangaiahgari
10,775,573 B1 9/2020 Hsu et al.
10,833,385 B2 11/2020 Mangaiahgari et al.
11,329,686 B2 * 5/2022 Xue ..... H01Q 1/526
2002/0021197 A1 2/2002 Elco
2002/0101385 A1 8/2002 Huor
2004/0066346 A1 * 4/2004 Huor ..... H01Q 21/064 343/770
2004/0069984 A1 4/2004 Estes et al.
2006/0113598 A1 6/2006 Chen et al.
2008/0129409 A1 6/2008 Nagaishi et al.
2008/0150821 A1 6/2008 Koch et al.
2009/0207090 A1 8/2009 Pettus et al.
2009/0243762 A1 10/2009 Chen et al.
2012/0013421 A1 1/2012 Hayata
2012/0026053 A1 * 2/2012 Focke ..... H01Q 21/005 343/771
2012/0050125 A1 3/2012 Leiba et al.
2012/0068316 A1 3/2012 Ligander
2012/0163811 A1 6/2012 Doany et al.
2012/0242421 A1 9/2012 Robin et al.
2012/0256796 A1 10/2012 Leiba
2013/0057358 A1 3/2013 Anthony et al.
2014/0015709 A1 * 1/2014 Shijo ..... H01Q 13/18 342/195
2014/0091884 A1 4/2014 Flatters
2014/0106684 A1 4/2014 Burns et al.
2015/0097633 A1 4/2015 Devries et al.
2015/0229017 A1 8/2015 Suzuki et al.
2015/0357698 A1 12/2015 Kushta
2015/0364804 A1 12/2015 Tong et al.
2015/0364830 A1 12/2015 Tong et al.
2016/0043455 A1 2/2016 Seler et al.
2016/0049714 A1 2/2016 Ligander et al.
2016/0118705 A1 4/2016 Tang et al.
2016/0204495 A1 7/2016 Takeda et al.
2016/0276727 A1 9/2016 Dang et al.
2016/0293557 A1 10/2016 Topak et al.
2016/0301125 A1 10/2016 Kim et al.
2017/0084554 A1 3/2017 Dogiamis et al.
2017/0324135 A1 11/2017 Blech et al.
2018/0024226 A1 * 1/2018 Izadian ..... H01Q 5/55 342/188
2018/0131084 A1 5/2018 Park et al.
2018/0226709 A1 8/2018 Mangaiahgari
2018/0233465 A1 8/2018 Spella et al.
2018/0284186 A1 10/2018 Chadha et al.
2018/0301816 A1 10/2018 Kamo et al.
2018/0343711 A1 11/2018 Wixforth et al.
2018/0351250 A1 12/2018 Achour et al.
2018/0351261 A1 * 12/2018 Kamo ..... H01P 5/087
2019/0006743 A1 1/2019 Kirino et al.
2019/0013563 A1 1/2019 Takeda et al.
2020/0021001 A1 1/2020 Mangaiahgairi
2020/0235453 A1 7/2020 Lang
2020/0343612 A1 10/2020 Shi
2021/0005981 A1 * 1/2021 Kuwabara ..... H01Q 21/064
2021/0036393 A1 2/2021 Mangaiahgari
2022/0342035 A1 * 10/2022 Smith ..... G01S 7/032

FOREIGN PATENT DOCUMENTS

CN 2796131 7/2006
CN 201383535 1/2010
CN 103515682 1/2014
CN 104900956 9/2015
CN 105609909 5/2016
CN 105680133 6/2016
CN 105958167 9/2016
CN 109378595 A * 2/2019 ..... H01P 5/103
CN 209389219 9/2019
CN 113097743 A * 7/2021 ..... H01Q 1/36
DE 102019200893 7/2020
EP 0205212 B1 * 11/1991
EP 708490 A1 * 4/1996 ..... H01L 23/3737
EP 2500978 9/2012
EP 2843758 3/2015
EP 3460903 3/2019
GB 2489950 10/2012
JP 2003289201 10/2003
KR 100846872 5/2008
KR 20090024064 A * 3/2009
KR 20090064287 A * 6/2009
WO 2013189513 12/2013
WO 2018003932 1/2018
WO WO-2022122319 A1 * 6/2022

OTHER PUBLICATIONS

"Foreign Office Action", CN Application No. 201810122408.4, dated Oct. 18, 2021, 19 pages.
"Non-Final Office Action", U.S. Appl. No. 16/829,409, dated Oct. 14, 2021, 13 pages.
"Non-Final Office Action", U.S. Appl. No. 17/061,675, dated Dec. 20, 2021, 4 pages.
Wang, et al., "Mechanical and Dielectric Strength of Laminated Epoxy Dielectric Graded Materials", Mar. 2020, 15 pages.
"Extended European Search Report", EP Application No. 18153137.7, dated Jun. 15, 2018, 8 pages.
"Extended European Search Report", EP Application No. 20166797, dated Sep. 16, 2020, 11 pages.
"Foreign Office Action", CN Application No. 201810122408.4, dated Jun. 2, 2021, 15 pages.
"Non-Final Office Action", U.S. Appl. No. 16/583,867, dated Feb. 18, 2020, 8 pages.
"Non-Final Office Action", U.S. Appl. No. 15/427,769, dated Nov. 13, 2018, 8 pages.
"Notice of Allowance", U.S. Appl. No. 15/427,769, dated Jun. 28, 2019, 9 pages.
"Notice of Allowance", U.S. Appl. No. 16/583,867, dated Jul. 8, 2020, 8 Pages.
Jankovic, et al., "Stepped Bend Substrate Integrated Waveguide to Rectangular Waveguide Transitions", Jun. 2016, 2 pages.

(56) References Cited

OTHER PUBLICATIONS

"Extended European Search Report", EP Application No. 21210143.
0, dated May 20, 2022, 9 pages.

* cited by examiner

WAVEGUIDE END ARRAY ANTENNA TO REDUCE GRATING LOBES AND CROSS-POLARIZATION

CROSS-REFERENCE TO RELATED APPLICATIONS

This application claims the benefit under 35 U.S.C. 119(e) of U.S. Provisional Application No. 63/169,104, filed Mar. 31, 2021, and U.S. Provisional Application No. 63/127,842, filed Dec. 18, 2020, the disclosures of which are hereby incorporated by reference in their entirety herein.

BACKGROUND

Some devices (e.g., radar) transmit or receive electromagnetic (EM) energy via one or more antennas to detect an object. These antennas may emit EM energy as radiation and can be characterized in terms of a radiation pattern. An effective radiation pattern may include one maximum (e.g., one grating lobe) of the radiation used to determine the location of an object. The radiation pattern may be improved using a waveguide to guide the EM energy to the antennas. However, some waveguides may cause antennas to produce multiple grating lobes in the radiation pattern, partially caused by cross-polarization of the EM energy, which may reduce the accuracy of object detection. An automobile may emit a radiation pattern towards a nearby area to detect if there are any pedestrians. If the radiation pattern, however, includes multiple grating lobes, then the car may incorrectly detect that a pedestrian is standing next to the car, when in fact, the pedestrian is standing in front of the car.

SUMMARY

This document describes techniques, apparatuses, and systems directed to a waveguide end array antenna to reduce grating lobes and cross-polarization. The waveguide end array antenna is referred to throughout this document as simply a waveguide for short. The waveguide utilizes a core made of a dielectric material (e.g., air) to guide EM energy from a waveguide input to one or more radiating slots (e.g., an antenna array). The dielectric core includes a main channel and one or more forks. Each fork connects the main channel to one or more tine sections, and each tine section is terminated by a closed end and a radiating slot. These radiating slots are separated from each other by a slot distance to enable at least a portion of the EM energy to dissipate in phase through the radiating slots in phase. The dielectric core of the waveguide reduces grating lobes and cross-polarization associated with the EM energy. An automobile can rely on the waveguide to detect objects with increased accuracy.

Aspects described below include a waveguide end array antenna configured to guide EM energy through a waveguide section comprising a dielectric core. The waveguide section includes a main channel used to guide the EM energy through a first part of the dielectric core. The main channel includes an open end within the first part of the dielectric core. The waveguide section also includes at least one fork arranged orthogonal to the main channel, used to guide the EM energy from the first part to a second part of the dielectric core. The at least one fork is terminated by two or more tine sections that each include a closed end and a radiating slot used to dissipate at least a portion of the EM energy to outside of the dielectric core.

BRIEF DESCRIPTION OF DRAWINGS

A waveguide end array antenna to reduce grating lobes and cross-polarization is described with reference to the following diagrams. The same numbers are used throughout the drawings to reference like features and components:

FIG. 2-1 illustrates a waveguide end array antenna to reduce grating lobes and cross-polarization, in accordance with techniques of this disclosure;

FIG. 2-2 illustrates a cross-sectional view of the waveguide shown in FIG. 2-1.

DETAILED DESCRIPTION

Overview

As mentioned in the Background, an effective radiation pattern may include one maximum (e.g., one grating lobe) to precisely determine a location of an object. The radiation pattern may be improved using a waveguide to guide the EM energy to an antenna. Some waveguides, however, may produce multiple grating lobes of the radiation pattern due to a size or shape of the waveguide. Furthermore, cross-polarization of the EM energy may occur and produce multiple grating lobes. These multiple grating lobes reduce the accuracy of object detection. For example, a sensor of an automobile emits a radiation pattern with multiple grating lobes into a nearby area and, instead of a primary grating lobe detecting a pedestrian, a secondary grating lobe detects the pedestrian. Therefore, the automobile incorrectly infers that the detection is in response to the primary grating lobe, when in fact, it was in response to the secondary grating lobe. In this example, the automobile incorrectly determines the location of the pedestrian based on the secondary grating lobe. The automobile determines that the pedestrian is standing next to the automobile, but instead, the pedestrian is standing in front of the automobile. Preventing secondary grating lobes and reducing cross-polarization of the EM energy may, therefore, improve the accuracy of object detection.

This document describes a waveguide that utilizes a dielectric core (e.g., comprising air) that includes a main channel used to guide the EM energy from a waveguide input to one or more radiating slots (e.g., the antenna array). This main channel can include a straight channel with a closed end positioned opposite the waveguide input. The waveguide input can be used to set a desired impedance and/or enable impedance match of the EM energy. The dielectric core also includes one or more forks. Each fork is used to connect the main channel to two or more tine sections, and each tine section is terminated with a closed end and a radiating slot (e.g., antenna). Each fork and each tine section are orientated orthogonal to the main channel. The radiating slots are also orientated orthogonal to the main channel and aligned in a row that is parallel to the main channel. The spacing between each radiating slot is set to enable at least a portion of the EM energy to be in phase as it dissipates out of the dielectric core. The features of this waveguide, by design, reduce grating lobes and cross-polarization associated with the EM energy, helping to improve the accuracy of object detections and improve automotive safety.

Example System

Figure 1:
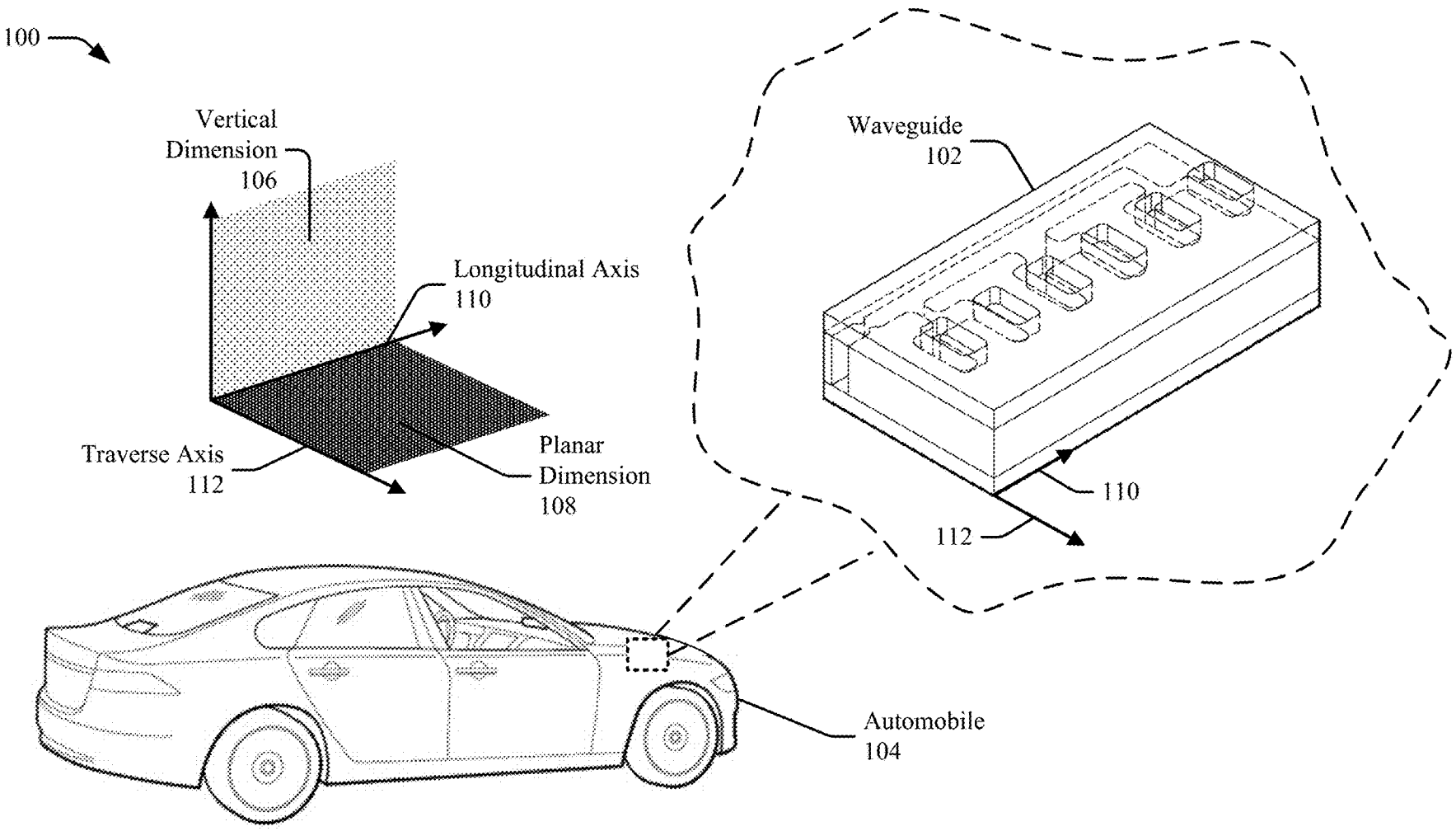
FIG. 1 illustrates an example environment including an automobile that includes a waveguide end array antenna to reduce grating lobes and cross-polarization, in accordance with techniques of this disclosure.

FIG. 1 illustrates an example environment including an automobile that includes a waveguide end array antenna to reduce grating lobes and cross-polarization, in accordance with techniques of this disclosure. The automobile 104 utilizes the waveguide 102 to perform operations of a radar system, for example, to determine a range or proximity to, an angle to, or a velocity of at least one object. For example, the waveguide 102 can be located on a front of the automobile 104 to detect the presence of nearby objects to avoid collisions. While the example environment 100 depicts an automobile 104, other vehicle systems (e.g., self-driving vehicles, semi-trailers, tractors, utility vehicles, motorcycles, public transportation, and so forth) may utilize a waveguide like that which is described herein.

The automobile 104 includes a device used to transmit and receive electromagnetic (EM) energy to detect objects and perform operations of the automobile 104. This device includes the waveguide 102 coupled to the device. The device can be hardware mounted to the automobile 104 and additionally include multiple waveguides, printed circuit boards (PCBs), electrical components, transducers, receivers, one or more processors, sensors (e.g., proximity sensors, location sensors), and so forth. The device can also include a computer-readable medium (CRM), suitable memory or storage device, an operating system, and so forth, which are executable by processors to enable operations of the automobile 104. The device can include a controller or control unit, a processor, a system on chip, a computer, a tablet, a wearable device, or other hardware.

The waveguide 102 can enable operations of a radar system that uses radio waves with a resonant frequency or range of frequencies that at least partially includes 30 hertz (Hz) to 300 gigahertz (GHz) to detect the presence of objects. While the automobile 104 depicted in the example environment 100 is primarily described in terms of a radar system, the automobile 104 may include other systems that may support the techniques described herein. Other systems can include low-frequency systems that use radio frequency waves at least partially including 30 kilohertz (kHz) to 300 kHz, ultrasonic systems that use ultrasonic waves at least partially including 20 kHz to 1 GHz, and systems that use EM waves outside of the 30 Hz to 300 GHz range.

The device includes EM energy that is generated or received by the device and sent to the waveguide 102. The waveguide 102 includes a hollow core filled with a dielectric material (e.g., a dielectric core) that is enclosed by a waveguide shell and used to transport the EM energy of the device to radiating slots (e.g., an antenna array). The waveguide shell can include multiple layers stacked within a vertical dimension 106 that is orthogonal to a planar dimension 108. The dielectric core includes a main channel aligned parallel to a longitudinal axis 110 and one or more forks connected to the main channel and aligned parallel to a traverse axis 112. Each fork is terminated by two or more tine sections aligned parallel to the traverse axis 112. The tine sections include closed ends and radiating slots which are used to dissipate at least a portion of the EM energy to outside of the dielectric core. Further details regarding the waveguide 102 are described with respect to FIGS. 2-1 and 2-2.

Example Waveguide

Figures 1, 2:
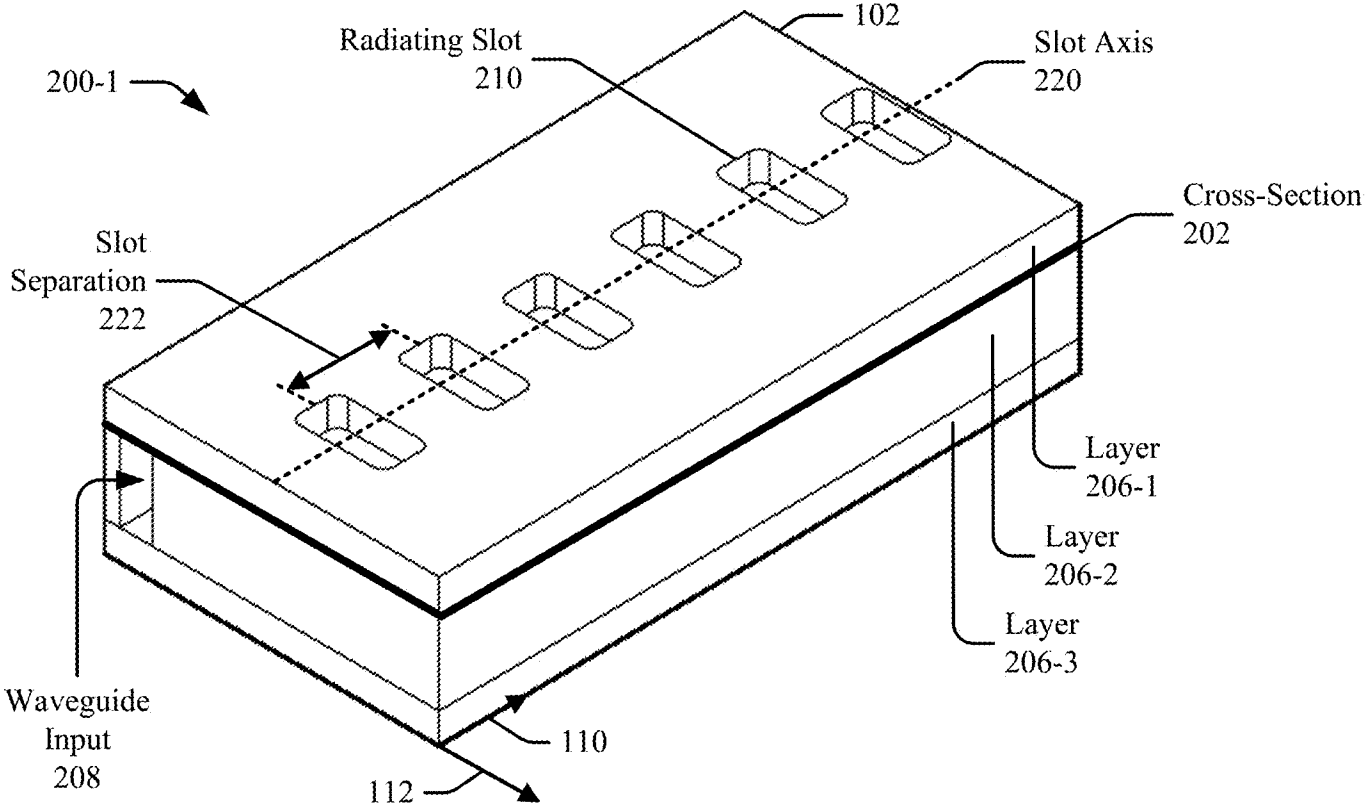
Figure 2:
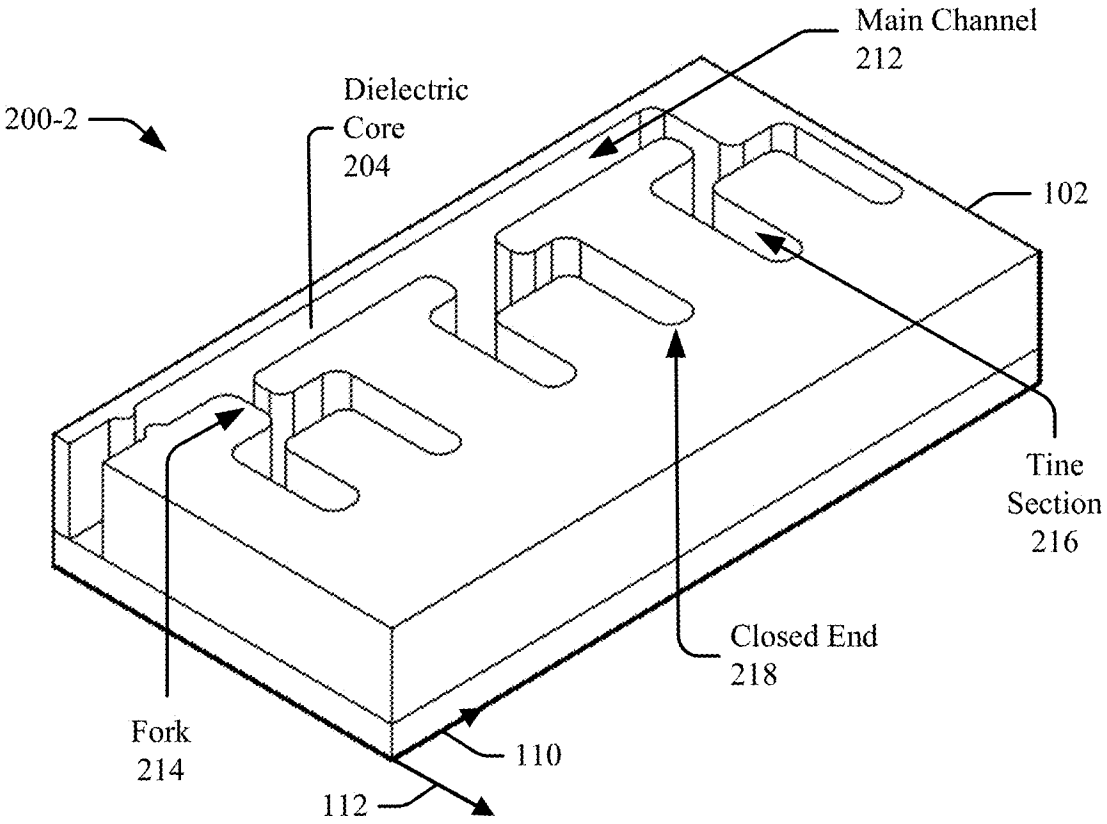

FIG. 2-1 illustrates a waveguide end array antenna to reduce grating lobes and cross-polarization, in accordance with techniques of this disclosure. The waveguide 102 is depicted in an example environment 200-1 with a cross-section 202 identified between layers of the waveguide 102. FIG. 2-2 illustrates a cross-sectional view of the waveguide 102 shown in FIG. 2-1. In example environment 200-2, the cross-sectional view is taken at the cross-section 202.

The waveguide 102 includes the dielectric core 204, which can be made of a dielectric material including air or other gas, a dielectric substrate, and so forth. The dielectric core 204 is enclosed by the waveguide shell, and the waveguide shell can be made of metal, a substrate, a substrate coated in metal, plastic, composite, fiber glass, other automotive materials, and so forth. The waveguide shell can include one or more layers (e.g., layer 206-1, layer 206-2, and layer 206-3), and each layer can be made of a different or similar material as another layer. While the example environment 200-1 illustrates the layers stacked along the vertical dimension 106, the layers can also be stacked parallel to the longitudinal axis 110 and traverse axis 112. Together, the dielectric core 204 and waveguide shell enable EM energy to be transported from a waveguide input 208 to radiating slots 210.

A size and a shape of the waveguide input 208 can set an initial impedance of the EM energy as it enters the dielectric core 204 and/or enable impedance matching. For example, the waveguide input 208 can excite a dominant mode (e.g., TE10) of the EM energy or enable impedance matching to a desired mode. The waveguide input 208 in example environments 200-1 and 200-2 is depicted with a rectangular opening and a notch inside the dielectric core 204. Though not depicted, the waveguide input 208 can include other shapes including a slit, an ellipse, a taper, and so forth.

After EM energy enters the waveguide 102 via the waveguide input 208, the EM energy is transported through the main channel 212. A size (e.g., a length, a width, a height) and shape of the main channel 212 can provide boundary conditions that enable a desired mode of the EM energy. The main channel 212 is shown in the example environment 200-2 as a straight channel aligned parallel to the longitudinal axis 110 with a closed end positioned opposite the waveguide input 208. Note that the layer 206-1 is removed in 200-2 to enable discussion of the dielectric core 204. Though not depicted, the main channel 212 can include any shape, for example, a curved shape, a shape with bends, and so forth.

While an aperture size (e.g., a size of a cross-section taken along the vertical dimension 106) of the main channel 212 is depicted to be the same along the longitudinal axis 110, in general, the aperture size can change at any location. For example, the aperture size can transition from a small aperture to a large aperture along the main channel 212. Though the aperture is depicted with a rectangular shape in 200-2, a shape of the aperture can include a square, a circle, an ellipse, a taper, and so forth.

The dielectric core 204 also includes one or more forks 214 connected to the main channel 212. The forks 214 are used to transport the EM energy from the main channel 212 to two or more tine sections 216 of the dielectric core 204. Example environment 200-1 depicts three forks 214. The size and shape of the forks 214 can vary, and each fork 214 can be similar or different in either shape or size to another fork 214. The forks 214 are depicted in 200-2 with an orientation orthogonal to the main channel 212 and parallel to the traverse axis 112. Each fork 214 is connected to at least two tine sections 216.

Each of the tine sections 216 of the dielectric core 204 includes a closed end 218 and at least one radiating slot 210. The tine sections 216 in 200-2 are depicted as a rectangular shape with a length (e.g., aligned parallel to the traverse axis 112) that is greater than a width (e.g., aligned parallel to the longitudinal axis 110). Though not depicted, a size and shape of the tine sections 216 can include various shapes (e.g., including a curved shape, a shape with bends), various aperture sizes, and various aperture shapes (e.g., a square, a circle, an ellipse, a taper). Each tine section 216 can be similar or distinct in a shape or size from another tine section 216. The spacing between tine sections 216 (e.g., a distance taken parallel to the longitudinal axis 110 between tine sections 216) can be similar or different if the waveguide 102 includes three or more tine sections 216.

Each closed end 218 in 200-2 is depicted at least partially inside layer 206-2 with a radiating slot 210 at least partially within layer 206-1 and connected to and positioned at least partially above a corresponding closed end 218. In general, each tine section 216 can include one or more radiating slot 210. Though the radiating slot 210 of 200-1 is depicted as a rectangular shape with rounded corners, other shapes can support the techniques described herein, including a circle, a rectangle, a square, an ellipse, a taper, and so forth. A depth (e.g., taken along the vertical dimension 106) of the radiating slot 210 can be configured to enable operations of the radar system. For example, the depth may be set at a quarter wavelength of a resonant wavelength (e.g., a dominant wavelength) of the EM energy. Each radiating slot 210 includes a slot width (e.g., aligned parallel to the longitudinal axis 110) and a slot length (e.g., aligned parallel to the traverse axis 112). Example environment 200-1 depicts the slot length greater than the slot width, but, in general, the slot length can be shorter than the slot width.

Each radiating slot 210 is depicted in 200-1 with a similar shape and size. However, each radiating slot 210 can differ in a shape or size from another radiating slot 210. Each radiating slot 210 is also centered about a slot axis 220 that is aligned parallel to the longitudinal axis 110 as depicted in 200-1. The radiating slots 210 are separated by a slot separation 222, which includes a distance between the center of each consecutive radiating slot 210. The slot separation 222 enables the EM energy to be in phase as it radiates out of the radiating slots 210. For example, the slot separation 222 can be set between a full wavelength and a half wavelength of the resonant wavelength of the EM energy. Further variations of the waveguide 102 are depicted in FIG. 3.

Figure 3:
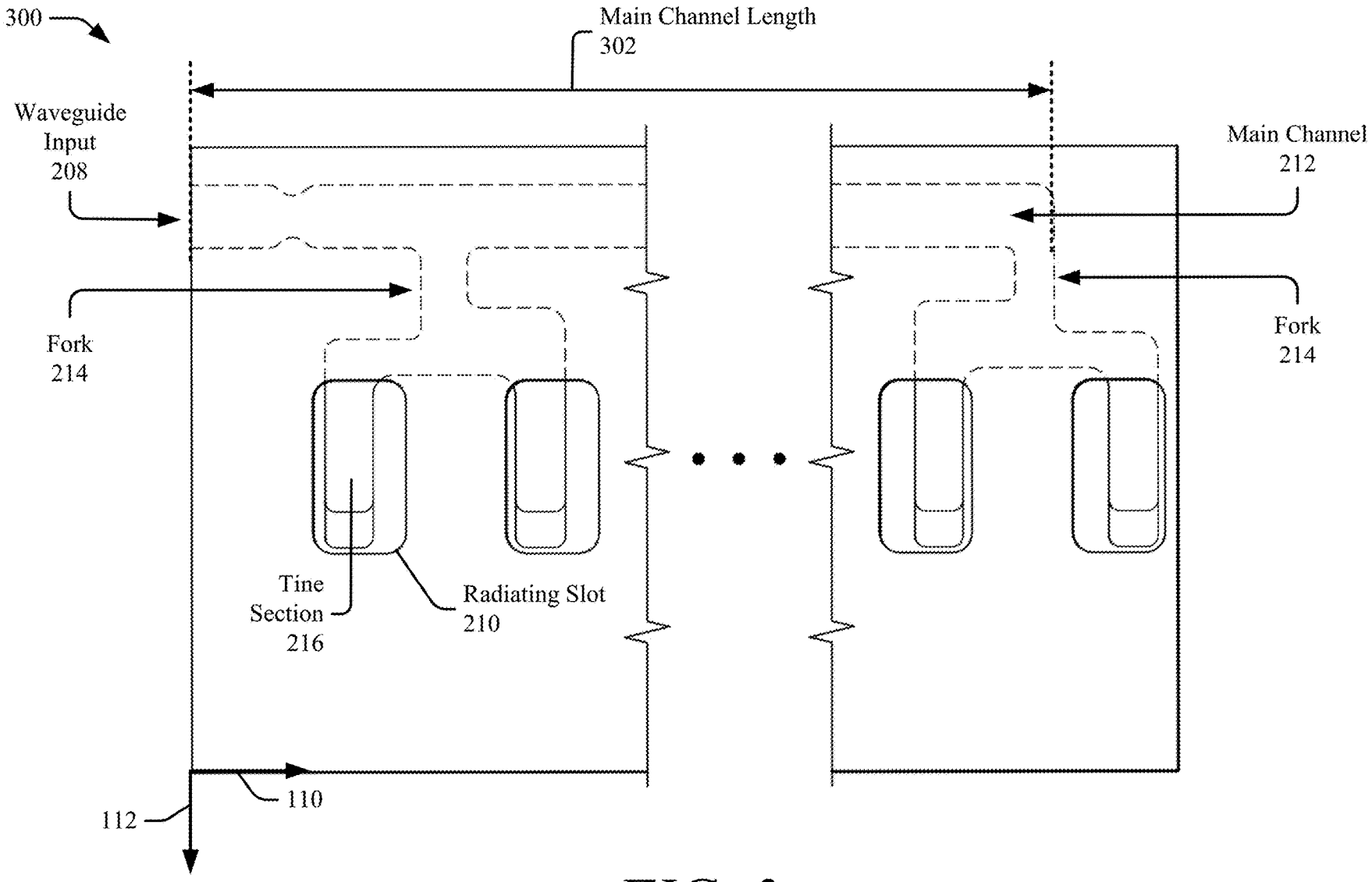
FIG. 3 illustrates a top view of the waveguide.

FIG. 3 illustrates a top view of the waveguide 102. In general, the waveguide 102 can include one or more forks 214, two or more tine sections 216, and one or more radiating slots 210 for each tine section 216. Example environment 300 depicts a waveguide 102 with two or more forks 214 as indicated by an ellipsis. As the number of forks 214 increases, a main channel length 302 increases to accommodate the slot separation 222 between radiating slots 210 aligned along the slot axis 220. The main channel length 302 includes a distance from the waveguide input 208 to a closed end positioned opposite the waveguide input 208. The main channel length 302 is measured relative to the longitudinal axis 110. This waveguide 102 is configured to reduce grating lobes and cross-polarization of the EM radiation (e.g., the EM energy being radiated out of the dielectric core 204 via the radiating slots 210) as further described with respect to FIG. 4.

Figure 4:
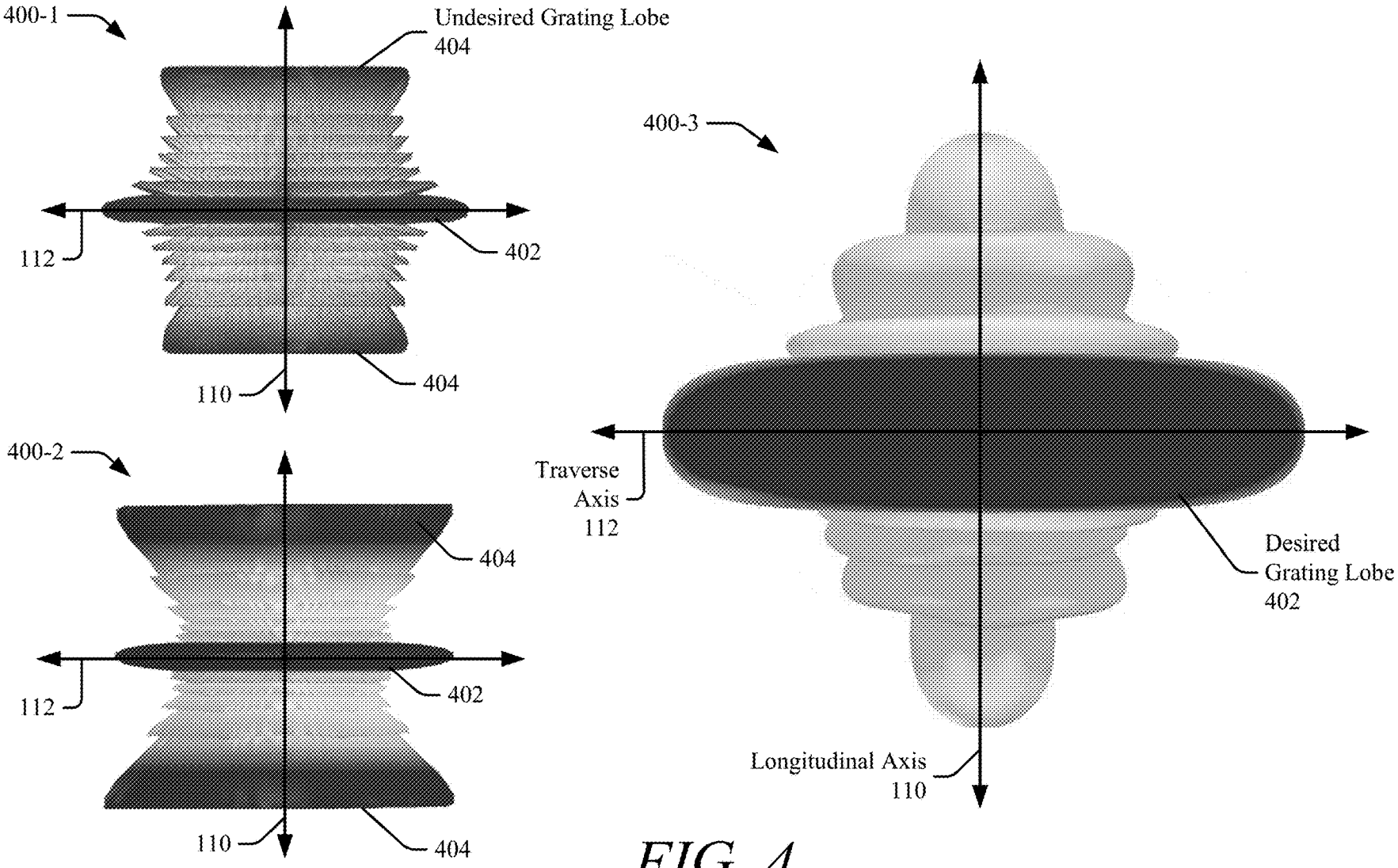
FIG. 4 illustrates a reduction in grating lobes and cross-polarization of the EM radiation using the waveguide.

FIG. 4 illustrates a reduction in grating lobes and cross-polarization of the EM radiation using the waveguide 102. The EM radiation can be sinusoidal and include both a direction of motion and a polarization (e.g., direction of oscillations). The radiating slots 210 transmit at least a portion of the EM energy as EM radiation from each radiating slot 210. For two or more radiating slots 210, the EM radiation is in phase due to the slot separation 222 and can be characterized in terms of a radiation pattern as depicted in 400-3.

In contrast, radiation patterns from devices that do not include the waveguide 102 (e.g., devices that include an alternative waveguide) are depicted in 400-1 and 400-2. FIG. 4 illustrates that the waveguide 102 results in reduced grating lobes in 400-3 when compared to 400-1 and 400-2. All three radiation patterns are two-dimensional plots of the EM radiation intensity projected onto the planar dimension 108. The two-dimensional plots are symmetric about the longitudinal axis 110, providing three-dimensional information about the radiation patterns within the vertical dimension 106. In 400-1, 400-2, and 400-3, darker regions correlate with higher intensity EM radiation.

In general, a radiation pattern can include one or more maximum as governed by sinusoidal equations of the EM radiation. A maximum, herein referred to as a grating lobe, can be used to determine the location of an object. The radiation pattern associated with the waveguide 102 is influenced, in part, by the slot separation 222 and a size and shape of the dielectric core 204. The radiation pattern is influenced by a steering angle, which is formed between the radiating slot 210 and the direction of the EM radiation as transmitted by the device. This steering angle can also influence the slot separation 222. For example, for steering angles less than 90°, the slot separation 222 can be set between a full wavelength and a half wavelength of the resonant wavelength of the EM energy to generate a desired grating lobe 402, centered about the origin or the coordinate system of 400-3. In 400-1, 400-2, and 400-3, the desired grating lobes 402 are centered about the longitudinal axis 110 and the traverse axis 112. The device of the automobile 104 can be configured to detect an object using the desired grating lobe 402 of 400-3.

The example radiation patterns of 400-1 and 400-2 do not use the waveguide 102 and instead may utilize alternative waveguides (e.g., including a different shape or size). The radiation patterns associated with the alternative waveguides feature undesired grating lobes 404 centered about the traverse axis 112 but offset from the center of the longitudinal axis 110. These radiation patterns each feature three distinct grating lobes, including a desired grating lobe 402 and two undesired grating lobes 404. These undesired grating lobes 404 can include a radiation intensity comparable (e.g., of similar intensity) to the desired grating lobe 402 intensity. The size or shape of the alternative waveguide and/or cross-polarization (e.g., misalignment of the polarization) of the EM radiation transmitted by the alternative waveguide can cause these undesired grating lobes 404.

For example, a car transmits a radiation pattern with multiple grating lobes into a nearby area to detect a pedestrian using an alternative waveguide. The radiation pattern is similar to 400-1 or 400-2, and one of the undesired grating lobes 404 detects the pedestrian. The car, however, was designed to detect the pedestrian using the desired grating lobe 402. Therefore, the car incorrectly assumes that the detection was made using the desired grating lobe 402. In this example, the car incorrectly determines the location of the pedestrian because the desired grating lobe 402 and the undesired grating lobe 404 are separated by a distance when transmitted into the nearby area. The car determines that the pedestrian is standing next to the car, when in fact, the pedestrian is standing in front of the car.

In contrast, the waveguide 102 does not feature the undesirable grating lobes 404 and instead features one desired grating lobe 402 used to the detect an object with improved accuracy.

Example Method

Figure 5:
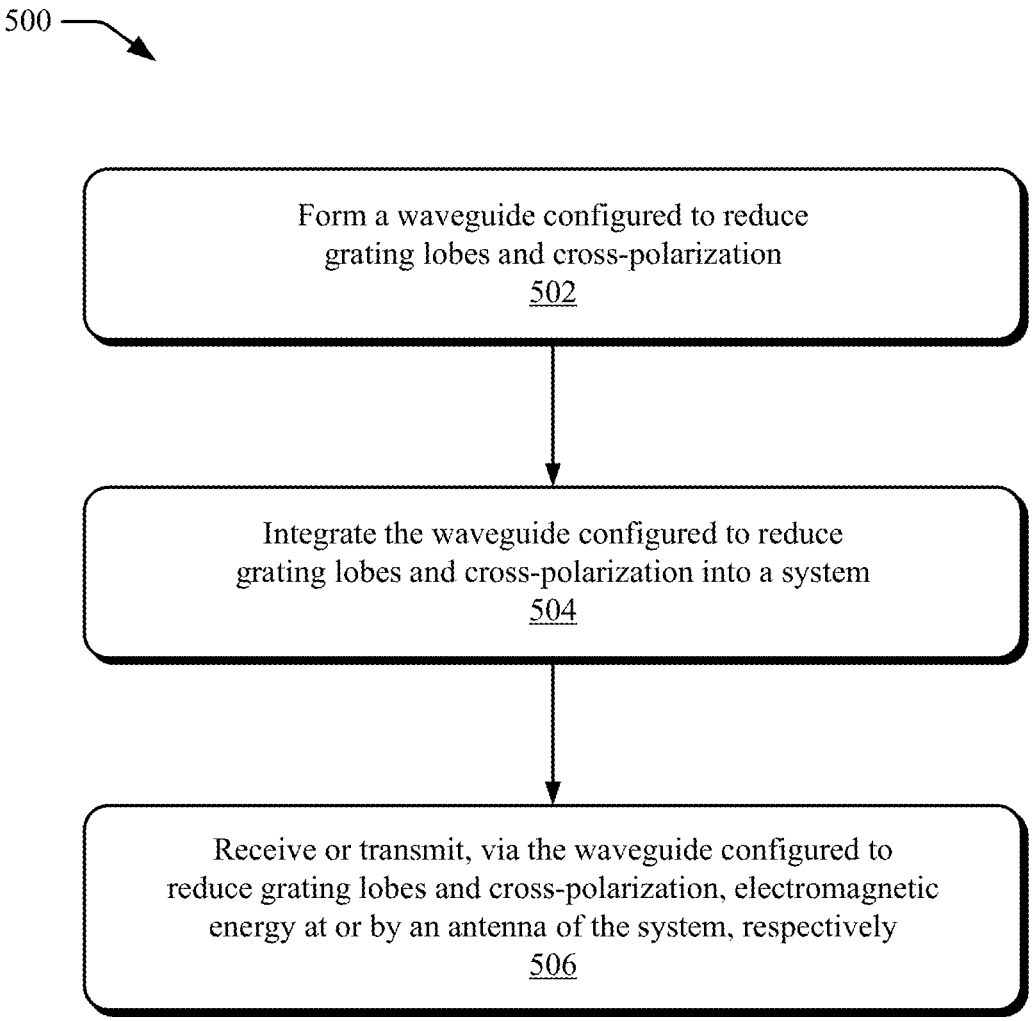
FIG. 5 illustrates a flowchart showing a process using a waveguide end array antenna to reduce grating lobes and cross-polarization, in accordance with techniques of this disclosure.

FIG. 5 illustrates a flowchart showing a process using a waveguide end array antenna to reduce grating lobes and cross-polarization, in accordance with techniques of this disclosure. The process 500 is shown as a set of operations 502 through 506, which are performed in, but not limited to, the order or combinations in which the operations are shown or described. Further, any of the operations 502 through 506 may be repeated, combined, or reorganized to provide other methods. In portions of the following discussion, reference may be made to the environment 100 and entities detailed in above, reference to which is made for example only. The techniques are not limited to performance by one entity or multiple entities.

At 502, a waveguide configured to reduce grating lobes and cross-polarization is formed. For example, the waveguide 102 can be stamped, etched, cut, machined, cast, molded, or formed in some other way. At 504, the waveguide configured to reduce grating lobes and cross-polarization is integrated into a system. For example, the waveguide 102 is electrically coupled to the device of the automobile 104. At 506, electromagnetic energy is received or transmitted via the waveguide configured to reduce grating lobes and cross-polarization at or by an antenna of the system, respectively. For example, the device of the automobile 104 receives or transmits EM energy via the waveguide 102 which is electrically coupled to an antenna of the automobile 104.

Additional Examples

Some Examples are described below.

Example 1: An apparatus, the apparatus comprising a waveguide end array antenna, the waveguide end array antenna configured to guide an electromagnetic (EM) energy through a waveguide section comprising a dielectric core, the waveguide section comprising a main channel configured to guide the EM energy through a first part of the dielectric core, the main channel comprising an open end within the first part of the dielectric core; and at least one fork arranged orthogonal to the main channel and configured to guide the EM energy from the first part to a second part of the dielectric core, the at least one fork terminated by two or more tine sections, each of the two or more tine sections comprising a closed end and a radiating slot configured to dissipate at least a portion of the EM energy to outside of the dielectric core.

Example 2: The apparatus as recited by example 1, wherein the main channel is further configured as a straight channel, the straight channel configured to guide the EM energy in a direction parallel to a longitudinal axis through the first part of the dielectric core, the straight channel comprising the open end within the first part of the dielectric core and another closed end positioned opposite the open end and within the first part of the dielectric core.

Example 3: The apparatus as recited by example 1, wherein the open end within the first part of the dielectric core is further configured as waveguide input to the main channel, the waveguide input comprising an opening of the waveguide end array antenna, the opening configured to enable the EM energy to enter the waveguide section.

Example 4: The apparatus as recited by example 3, wherein a size and a shape of the waveguide input is configured to set an initial impedance of the EM energy or enable impedance matching of the EM energy.

Example 5: The apparatus as recited by example 1, wherein the two or more tine sections further comprise a length of each tine section is greater than a width of each tine section.

Example 6: The apparatus as recited by example 5, wherein the radiating slots comprise a slot length arranged parallel to the length of each tine section, the slot length greater than a slot width, the slot width arranged orthogonal to the length of each tine section.

Example 7: The apparatus as recited by example 1, wherein the radiating slots are positioned at least partially above the closed ends.

Example 8: The apparatus as recited by example 1, wherein the radiating slots further comprise a first radiating slot and a second radiating slot, the first radiating slot separated from the second radiating slot by a slot separation, the slot separation configured to cause the EM energy to be in phase as the at least a portion of the EM energy dissipates to outside of the dielectric core.

Example 9: The apparatus as recited by example 8, wherein the slot separation is further configured to reduce one or more grating lobes attributed to the EM energy as the at least a portion of the EM energy dissipates to outside of the dielectric core, the one or more grating lobes being maxima of the radiation.

Example 10: The apparatus as recited by example 8, wherein the first radiating slot and the second radiating slot are centered about a slot axis, the slot axis aligned parallel to the main channel.

Example 11: The apparatus as recited by example 8, wherein the at least one fork further comprises a first fork and a second fork, the first fork comprising the two or more tine sections, the second fork comprising another two or more tine sections, the first fork separated from the second fork by a fork separation, the fork separation configured to enable the slot separation.

Example 12: The apparatus as recited by example 8, wherein the slot separation being further configured between a full wavelength of the EM energy and a half wavelength of the EM energy, the EM energy oscillating at the full wavelength.

Example 13: The apparatus as recited by example 1, wherein the waveguide end array antenna is further configured to reduce cross-polarization of a radiation of the EM energy as the at least a portion of the EM energy dissipates to outside of the dielectric core, wherein the EM energy further comprises a polarization of the EM energy; the polarization configured to enable oscillations of the EM energy in a direction; the cross-polarization of the radiation comprising at least two directions of the EM energy from at least two radiating slots; and the at least two directions being different.

Example 14: The apparatus as recited by example 1, wherein a size of the main channel increases as an amount of the at least one fork increases.

Example 15: The apparatus as recited by example 1, wherein the dielectric core comprises air.

Example 16: The apparatus as recited by example 1, wherein the waveguide end array antenna further comprises the dielectric core positioned at least partially within a waveguide shell, the waveguide shell configured to at least partially enclose the dielectric core, the waveguide shell comprising one or more of the following: a metal; a substrate; or a metal-plated material.

Example 17: The apparatus as recited by example 1, wherein the waveguide end array antenna further comprises an injection-molded waveguide end array antenna, the injection-molded waveguide end array antenna formed using an injection-molding process, the injection-molding process comprises pouring a material into a mold to form the injection-molded waveguide end array antenna.

Example 18: A system, the system comprising a device configured to transmit or receive electromagnetic (EM) energy; and a waveguide end array antenna coupled to the device, the waveguide end array antenna configured to guide the EM energy through a waveguide section comprising a dielectric core, the waveguide section comprising a main channel configured to guide the EM energy through a first part of the dielectric core, the main channel comprising an open end within the first part of the dielectric core; and at least one fork arranged orthogonal to the main channel and configured to guide the EM energy from the first part to a second part of the dielectric core, the at least one fork terminated by two or more tine sections, each of the two or more tine sections comprising a closed end and a radiating slot configured to dissipate at least a portion of the EM energy to outside of the dielectric core.

Example 19: The system as recited by example 18, wherein the device comprises a radar device.

Example 20: The system as recited by example 18, wherein the system further comprises a vehicle, the vehicle comprising the device and the waveguide end array antenna.

CONCLUSION

Although apparatuses including a waveguide end array antenna to reduce grating lobes and cross-polarization have been described in language specific to features, it is to be understood that the subject of the appended claims is not necessarily limited to the specific features described herein. Rather, the specific features are disclosed as example implementations of a waveguide end array antenna to reduce grating lobes and cross-polarization.

What is claimed is:

1. An apparatus, the apparatus comprising: a waveguide end array antenna, the waveguide end array antenna configured to guide an electromagnetic (EM) energy through a waveguide section comprising a dielectric core, the waveguide section comprising: a main channel configured to guide the EM energy through a first part of the dielectric core, the main channel being a straight channel comprising an open end within the first part of the dielectric core and a closed end positioned opposite the open end and within the first part of the dielectric core, the main channel having a length that is aligned parallel to a longitudinal axis, the open end and the closed end being arranged orthogonal to the longitudinal axis and parallel to one another; and at least one fork arranged orthogonal to the main channel, a first portion of the at least one fork being parallel to a traverse axis in a planar dimension, the traverse axis being orthogonal to the longitudinal axis and forming the planar dimension together with the longitudinal axis, the at least one fork being configured to guide the EM energy from the first part to a second part of the dielectric core, the at least one fork being further arranged with a second portion parallel to the longitudinal axis and comprising at least two right angle bends, the at least one fork terminated by two or more tine sections, each of the two or more tine sections arranged orthogonal to the main channel and parallel to the traverse axis and comprising a second closed end and a radiating slot configured to dissipate at least a portion of the EM energy to outside of the dielectric core, wherein the radiating slots are positioned at least partially above each second closed end, and wherein the main channel, the at least one fork, and the two or more tine sections are arranged in a first horizontal layer of the waveguide section and the radiating slot being arranged in a second horizontal layer above the first horizontal layer along a vertical axis that is orthogonal to the planar dimension.

2. The apparatus as recited by claim 1, wherein a width of the radiating slot along the longitudinal axis is wider than a width of each of the two or more tine sections along the longitudinal axis.

3. The apparatus as recited by claim 1, wherein the open end within the first part of the dielectric core is further configured as a waveguide input to the main channel, the waveguide input comprising an opening of the waveguide end array antenna, the opening configured to enable the EM energy to enter the waveguide section.

4. The apparatus as recited by claim 3, wherein a size and a shape of the waveguide input is configured to set an initial impedance of the EM energy or enable impedance matching of the EM energy.

5. The apparatus as recited by claim 1, wherein the two or more tine sections further comprise a length of each tine section that is greater than a width of each tine section.

6. The apparatus as recited by claim 5, wherein the radiating slots comprise a slot length arranged parallel to the length of each tine section, the slot length is greater than a slot width, the slot width arranged orthogonal to the length of each tine section.

7. The apparatus as recited by claim 1, wherein the radiating slots further comprise a first radiating slot and a second radiating slot, the first radiating slot separated from the second radiating slot by a slot separation, the slot separation configured to cause the EM energy to be in phase as the at least a portion of the EM energy dissipates to outside of the dielectric core.

8. The apparatus as recited by claim 7, wherein the slot separation is further configured to reduce one or more grating lobes attributed to the EM energy as the at least a portion of the EM energy dissipates to outside of the dielectric core, the one or more grating lobes being maxima of the radiation.

9. The apparatus as recited by claim 7, wherein the first radiating slot and the second radiating slot are centered about a slot axis, the slot axis aligned parallel to the main channel.

10. The apparatus as recited by claim 7, wherein the at least one fork further comprises a first fork and a second fork, the first fork comprising the two or more tine sections, the second fork comprising another two or more tine sections, the first fork separated from the second fork by a fork separation, the fork separation configured to enable the slot separation.

11. The apparatus as recited by claim 7, wherein the slot separation being further configured between a full wavelength of the EM energy and a half wavelength of the EM energy, the EM energy oscillating at the full wavelength.

12. The apparatus as recited by claim 1, wherein the waveguide end array antenna is further configured to reduce cross-polarization of a radiation of the EM energy as the at least a portion of the EM energy dissipates to outside of the dielectric core, wherein:

the EM energy further comprises a polarization of the EM energy;

the polarization is configured to enable oscillations of the EM energy in a direction;

the cross-polarization of the radiation comprises at least two directions of the EM energy from at least two radiating slots; and the at least two directions are different.

13. The apparatus as recited by claim 1, wherein a size of the main channel increases as an amount of the at least one fork increases.

14. The apparatus as recited by claim 1, wherein the dielectric core comprises air.

15. The apparatus as recited by claim 1, wherein the waveguide end array antenna further comprises the dielectric core positioned at least partially within a waveguide shell, the waveguide shell configured to at least partially enclose the dielectric core, the waveguide shell comprising one or more of the following:

a metal;

a substrate; or a metal-plated material.

16. The apparatus as recited by claim 1, wherein the waveguide end array antenna further comprises an injection-molded waveguide end array antenna, the injection-molded waveguide end array antenna formed using an injection-molding process, the injection-molding process comprises pouring a material into a mold to form the injection-molded waveguide end array antenna.

17. A system, the system comprising: a device configured to transmit or receive electromagnetic (EM) energy; and a waveguide end array antenna coupled to the device, the waveguide end array antenna configured to guide the EM energy through a waveguide section comprising a dielectric core, the waveguide section comprising: a main channel configured to guide the EM energy through a first part of the dielectric core, the main channel being a straight channel and comprising an open end within the first part of the dielectric core and a closed end positioned opposite the open end and within the first part of the dielectric core, the main channel having a length that is parallel to a longitudinal axis, the open end and the closed end being arranged orthogonal to the longitudinal axis and parallel to one another; and at least one fork arranged orthogonal to the main channel, a first portion of the at least one fork being parallel to a traverse axis in a planar dimension, the traverse axis being orthogonal to the longitudinal axis and forming the planar dimension together with the longitudinal axis, the at least one fork being configured to guide the EM energy from the first part to a second part of the dielectric core, the at least one fork being further arranged with a second portion parallel to the longitudinal axis and comprising at least two right angle bends, the at least one fork terminated by two or more tine sections, each of the two or more tine sections arranged orthogonal to the main channel and parallel to the traverse axis and comprising a second closed end and a radiating slot configured to dissipate at least a portion of the EM energy to outside of the dielectric core, wherein the radiating slots are positioned at least partially above each second closed end, and wherein the main channel, the at least one fork, and the two or more tine sections are arranged in a first horizontal layer of the waveguide section and the radiating slot being arranged in a second horizontal layer above the first horizontal layer along a vertical axis that is orthogonal to the planar dimension.

18. The system as recited by claim 17, wherein the device comprises a radar device.

19. The system as recited by claim 17, wherein the system further comprises a vehicle, the vehicle comprising the device and the waveguide end array antenna.

* * * * *